United States Patent [19]

Niskanen

[11] Patent Number: 4,889,598

[45] Date of Patent: Dec. 26, 1989

[54] METHOD FOR DETACHING A WEB FROM A SURFACE OF A ROLL WITH INDUCTIVE HEATING

[75] Inventor: Juhani Niskanen, Muurame, Finland

[73] Assignee: Valmet Paper Machinery, Inc., Finland

[21] Appl. No.: 147,695

[22] Filed: Jan. 25, 1988

[30] Foreign Application Priority Data

Jan. 23, 1987 [FI] Finland ..... 870309

[51] Int. Cl.[4] ..... D21F 3/00

[52] U.S. Cl. ..... 162/199; 34/117; 34/120; 100/38; 100/93 RP; 162/206; 162/207; 162/359; 162/360.1

[58] Field of Search ..... 162/305, 359, 360.1, 162/198, 199, 206, 207; 100/93 RP, 38; 34/116, 117, 120, 1; 219/10.43, 10.61 R

[56] References Cited

U.S. PATENT DOCUMENTS

| | | | |
|---|---|---|---|
| 3,868,780 | 4/1975 | Soininente et al. | 34/116 |
| 4,056,433 | 11/1977 | Koporen et al. | 162/359 |
| 4,384,514 | 5/1983 | Larive et al. | 100/93 RP |
| 4,551,203 | 11/1985 | Eskelinen | 162/207 |
| 4,614,565 | 9/1986 | Riihinen | 162/206 |
| 4,653,395 | 3/1987 | Verkasala | 100/38 |
| 4,675,487 | 6/1987 | Verkasala | 100/93 RP |

*Primary Examiner*—Karen Hastings

*Attorney, Agent, or Firm*—Steinberg & Raskin

[57] ABSTRACT

Method and device in a press section of a paper machine for detaching a web from a smooth face of a press roll. Momentary and local heating effect is directed at the web from outside the roll within the area or vicinity of a detaching point thereof. Material is used as the mantle or outer coating of the smooth-face roll which is at least somewhat magnetically conductive. An inductive heating effect is applied to the roll mantle free of contact therewith, and of such a high frequency, that depth of penetration of the heating effect remains sufficiently low in view of the local and momentary nature. Due to this heating effect, water present between the web and roll face is heated, even vaporized locally within the area of the detaching point, thereby detaching the web from the roll face. The electrical frequency of the induction heating is generally within the range of about 0.5 to 2 mHz, preferably within the range of about 0.8 to 1.5 mHz.

26 Claims, 5 Drawing Sheets

METHOD FOR DETACHING A WEB FROM A SURFACE OF A ROLL WITH INDUCTIVE HEATING

BACKGROUND THE INVENTION

The present invention concerns a method in a press section of a paper machine, for detaching a web from a smooth face of a press roll.

The present invention also concerns a device making use of the method in accordance with the present invention in the press section of a paper machine, the press section including a smooth-faced press roll, preferably a central roll. The web can be detached from the smooth face of this roll and then passed to a drying section of the paper machine.

So-called closed press sections are commonly used in a paper machine, in which one press nip or, as a rule, several press nips is/are formed in conjunction with a central roll. An example of such a previously-used press section, is a press section marketed by the assignee under the trademark "SYM-PRESS II", where a smooth-faced central having a larger diameter than diameters of the other press rolls, is usually make of rock, as a rule of granite. Since granite is an unhomogenous natural material of low tensile strength, it is quite questionable in machine construction. For example, if a granite roll is desirably heated, deformations thereof which are dependant upon temperature, are non-linear and difficult to predict.

Granite has relatively good properties as press roll material for detaching a web, which is at least one of the reasons for its repute. However, the detaching properties could be better, especially with regard to unbleached paper qualities.

In a manner known in the prior art, the web is detached as an open, unsupported draw from a face of the central roll in the press. This open draw is quite critical in view of the operation of the paper machine. In this open draw, a difference in speed is utilized for extending the web, which results in certain drawbacks. Moreover, the open draw forms a questionable point susceptible to breaks in the paper machine.

Prior art technology has not provided sufficient means for controlling detaching of a web from a smooth-faced central roll, and the subsequent open draw. The unfavorable properties of granite have, for their part, also made control of the detaching and the open draw more difficult. The open draw of the web has become an increasingly important and questionable point, with the continuously increasing running speeds of paper machines. Since different paper qualities are often manufactured by a paper machine, with adhesion to the face of the rock roll being different, variations in detaching tension required for a web result.

In a SYM-PRESS II press section, the properties of the surface of the central roll in the second and third press nips must be such that the moist web adheres to the roll face as best as possible. On the other hand, the web should be readily detachable from the roll face, for transfer to the drying section. Attaining these paradoxical requirements has not been completely successful in all respects, by the means known in the prior art.

SUMMARY OF THE INVENTION

Accordingly, it is an object of the present invention to provide new and improved detaching of a web from a central roll or equivalent in a press section, and the transfer thereof to the drying section.

It is also an object of the present invention to provide a method and device for detaching the web from a smooth-faced press roll, so that the web does not have to be extended.

It is another object of the present invention to eliminate use of a so-called draw and difference in speed, in detaching a web from a press roll.

It is a further object of the present invention to provide a press section in which it is possible to use a totally closed draw, if necessary, when the web is transferred from a central roll or from a corresponding different roll in the press to the drying section, as a rule onto a drying wire thereof.

These and other objects are attained by the present invention which is directed to a method for detaching a web from a surface of a roll, which comprises the steps of directing a heating effect at the web from outside the roll and within a vicinity of a point of detachment of the web off the roll, and thereby heating water present between the web and roll surface within the vicinity of the detaching point, so as to detach the web from the roll surface. The heating is locally and momentarily applied to the web in the vicinity of the detaching point, so that the water is locally heated within this vicinity. At least part of the water may be vaporized by this heating. The roll itself may be a smooth-surfaced press roll, with a mantle or outer coating provided thereon which is made of a material at least partially magnetically conductive. An inductive heating effect is applied onto the roll mantle without contact, and with a sufficiently high frequency so that depth of penetration of the heating effect remains sufficiently low, in view of the local and momentary nature of application.

The present invention is also directed to a device for detaching a web from a surface of a roll, which comprises an inductive heating device situated in a vicinity of a detaching point of the web off the roll surface and at a distance away therefrom, to form a gap therebetween. As noted above, the roll may be a smooth-surfaced press roll, preferably a central roll of a press section in a paper machine. A drying wire or transfer fabric may be provided, onto which the web is passed after being detached from the roll, for transfer to a drying section of the machine. The roll surface is made of magnetically conductive material, with the heating device being an electroinductive heating device comprising at least one magnetically conductive core situated at the distance away from the roll surface, and at least one coil about the core. The magnetically conductive material is preferably ferromagnetic material. The heating device may also comprise means for providing electrical current through the coil of sufficiently high frequency, for ensuring sufficiently low depth of penetration of inductive heating effect into the roll, in view of the momentary and localized nature of the applied heating effect.

These and other objects which will become apparent below, are attained by the method of the present invention which is principally characterized by a momentary and local heating effect being directed at the web from outside the roll within the area or vicinity of the detaching point of the web off the roll, a material being used for a mantle or outer coating of the smooth-faced roll which is at least partially magnetically conductive to some extent, an induction heating effect being applied to the roll mantle free of contact and of such a high frequency that depth of penetration of the heating effect remains sufficiently low, in view of the local and momentary nature thereof, and by means of the applied heating effect, water present between the web and the roll face is heated, preferably vaporized, locally within the area of the detaching point, so as to detach the web off the roll face.

Additionally, the device in accordance with the present invention is principally characterized by an electroinductive heating device being provided in connection with the smooth-faced press roll at the proximity of the transfer point. A front of a core of the heating device is situated to form an air gap between the same and the roll surface at the detaching point, while the roll surface is made of magnetically conductive, preferably ferromagnetic material. More specifically, the induction heating device comprises one or several magnetically conductive coil cores, as well as one or several electrical coils. The device further includes high-frequency apparatus, by means of which an electrical current of such a high frequency can be passed to the coil or coils, so that in view of the momentary and local nature of the heating effect, a sufficiently low depth of penetration is obtained for the induction heating effect at the roll face.

In the present invention, the central roll of the press or any other corresponding smooth-faced roll from which the paper web is intended to be detached, is a substantially metal-mantle roll coated with a metal or metal alloys, or a cast-iron roll, or an uncoated metal roll, preferably a roll constructed of ferromagnetic material.

The present invention can be advantageously applied in a press section in which the basic temperature of the smooth-faced roll is about 60°–90° C., preferably about 70° C., while the properties of the roll face are hydrophilic, i.e., such that the web adheres to the face well. In such a case, by means of the induction heating in accordance with the present invention, the surface temperature of the roll at the detaching point is momentarily (i.e. for just a short period of time) and locally raised to about 110° C.–130° C., preferably about 120° C.

In other words, such a heating capacity is used that the temperature of the roll surface rises within the detaching area, locally and momentarily, by about 40° C.–60° C., preferably about 50° C.

The water layer present between the web and the roll face is thereby at least partially vaporized, while a thin vapor film is formed which does not maintain the web in contact with the roll face. In other words, the web is then detached from the roll surface.

Since the web detaching operation takes place by means of vaporization in accordance with the present invention, it is not at all necessary to extend the web in order to detach the same. Thus, a closed draw from the central roll of the press section to the drying section, for example onto the drying wire thereof, is permitted in accordance with the present herein.

The present invention is by no means restricted to use for detaching a web from a central roll of closed press sections of paper machines alone. Rather, the present invention is suited and intended for detaching of the web from a smooth-face roll in a press section, in general.

The temperature profile of the central roll or a corresponding smooth face of a roll can be arranged to be adjustable over the axial direction of the roll, in the present invention. By means of this procedure, it is possible to optimally set distribution of the detaching tension over the transverse direction of the web, and to prevent curve formation along the detaching line in the lateral areas of the web, and thereby prevent breaks in the web which usually begin in the lateral areas thereof.

The advantages of the present invention are exhibited with special emphasis on thin paper qualities, with which it is possible to reduce the number of web breaks taking place in an open draw to a substantial extent, as compared to the prior art.

BRIEF DESCRIPTION OF THE DRAWINGS

Background of the present invention and certain of the exemplifying embodiments of the invention herewith, will be described in greater detail below, with reference to illustrations in the accompanying drawings, in which.

DESCRIPTION OF THE PREFERRED EMBODIMENTS

Figure 1:
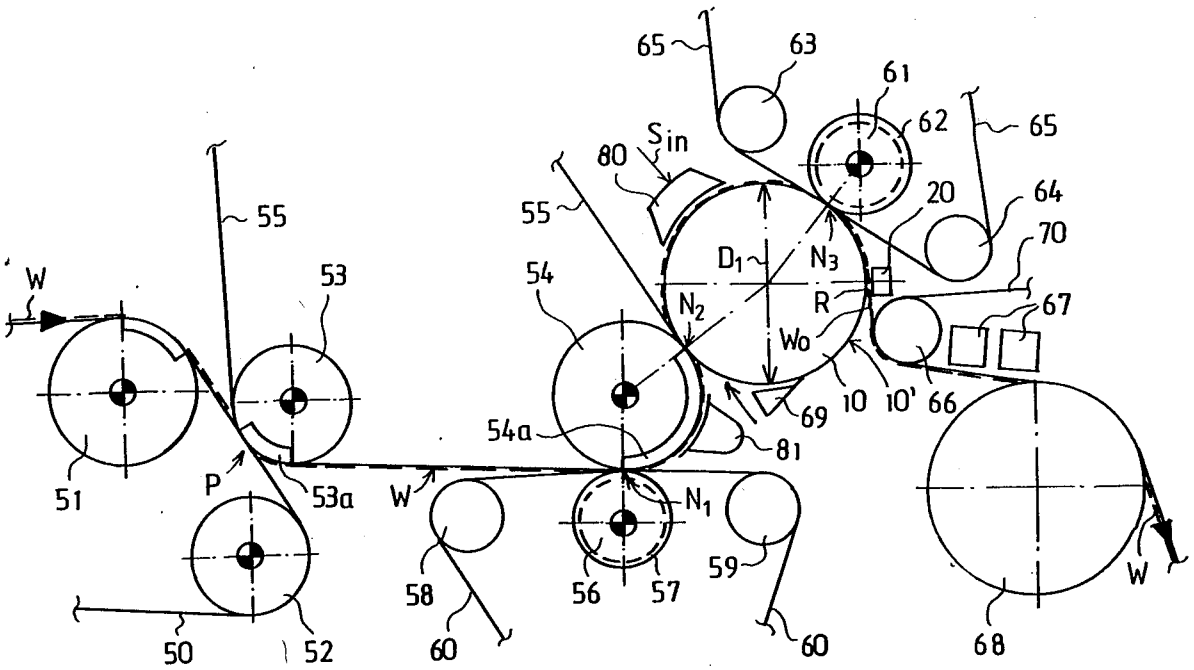
FIG. 1 is a schematic view of a closed press section, provided with an induction device and making use of the method in accordance with the present invention.

FIG. 1 is a schematic side view of assignee's "SYMPRESS" press section, in which a web W detaching system in accordance with the present invention is applied. Firstly, the overall construction of the press section illustrated in FIG. 1 will be described as background to the invention herein. The paper web W is drained upon a forming wire 50 of the paper machine, from which the web W is detached on a downwardly inclined run of the wire 50 between wire guide rolls 51 and 52 at a detaching point P, and transferred within a suction zone 53*a* of a pick-up roll 53 onto a pick-up felt 55. The web W is transferred into a first dewatering press nip $N_1$ on a lower face of the pick-up felt 55.

The first nip $N_1$ is formed between a press-suction roll 54 and a hollow-face 57 lower press roll 56. Two felts run through the nip $N_1$, namely a lower felt 60 guided by guide rolls 58 and 59, and the pick-up felt 55, which acts as an upper felt in the first press nip $N_1$. After the first nip $N_1$, the web W follows along with the upper roll by effect of the suction zone 54*a* of this press-suction roll 54, moving into a second dewatering press nip $N_2$ which is formed between the press-suction roll 54 and a smooth-faced 10' central roll 10. Diameter $D_1$ of the central roll 10 is substantially larger than diameters of other press rolls 54, 56, 61. Therefore, there is space for various apparatus to be fitted around the central roll 10, including heating apparatus applied in accordance with the present invention. There is a steam box 81 within the suction sector 54a of the suction roll 54, which acts upon an outer face of the web W and raises the temperature of the web W and of the water contained therein, thereby lowering viscosity of the water.

At substantially the opposite side of the central roll 10, relative to the second nip $N_2$, there is a third dewatering press nip $N_3$, through which the press felt 65 runs as guided by the guide rolls 63 and 64. The rolls forming the nip $N_3$ are central roll 10, and a hollow-face 62 press roll 61.

Adhesion properties of the smooth face 10' of the central 10, are such that the web follows along with the face 10' of the central roll 10 after the second nip $N_2$. There is a doctor 69 on a lower free sector of the central roll 10, which keeps the roll face 10' clean and detaches the paper web of the roll face 10' which becomes broke. The web is detached at the detaching point R from the face 10' of the central roll 10 as an open draw $W_0$, and transferred onto a drying wire 70, having a loop brought to as short a distance as possible from the roll 10 face 10', and being guided by a guide roll 66. After the guide roll 66, there are suction boxes 67 situated inside the loop of the drying wire 70, which ensure that the web W adheres to the drying wire 70 and reliably passes to the drying section. The first drying cylinder or corresponding lead-cylinder of the drying section, is denoted by reference No. 68.

Generally, it has been ascertained that the smaller the detaching angle of the web W, i.e., the angle between an imaginary tangential plane at the detaching point R and a running plane of the web W, the higher the detaching tension that is required. Furthermore, the detaching tension is determined by difference of speeds of the drying wire 70 and of the face 10' of the central roll 10, i.e., by the so-called draw difference.

A steam box 80 shown in FIG. 1 with steam $S_{in}$ passed thereinto, is not necessarily required, however, it may be used either for intensification of the dewatering in the last nip $N_3$ and/or in order to set the basic level of the temperature of the face 10' of the central roll 10 to be suitable, e.g., about 60° C.–90° C., preferably about 70° C., and optimal in view of the operation of the detaching device 20 in accordance with the present invention.

In accordance with the invention herein, an induction heating device 20 is used within an area or vicinity of the detaching point R, this device being fed with high-frequency electricity. The frequency f thereof, is in a manner which will become apparent below, set so high that depth of penetration at the face 10' of the roll 10 is very little. In the present invention, a frequency, e.g. of f = about 1 MHz is used, so that with steel, a penetration depth of about 0.02 mm is attained at a web speed of about 20 m/s, and with an electric capacity of about 40 kW per meter of roll length. This means that temperature of the roll face 10' rises within the detaching area R only momentarily and locally by about 50° C. If the basic temperature of the roll is about 70° C., then the temperature locally rises to about 120° C. with respect to the induction heating within the detaching area. The water layer thereby present between the web W and the roll face 10' is at least partially vaporized, with a thin vapor film being formed which will not maintain the web W in contact with roll 10'. Rather, the web W is detached from the roll face and can be immediately passed to a drying section, e.g., onto a drying wire 70.

Figure 2:
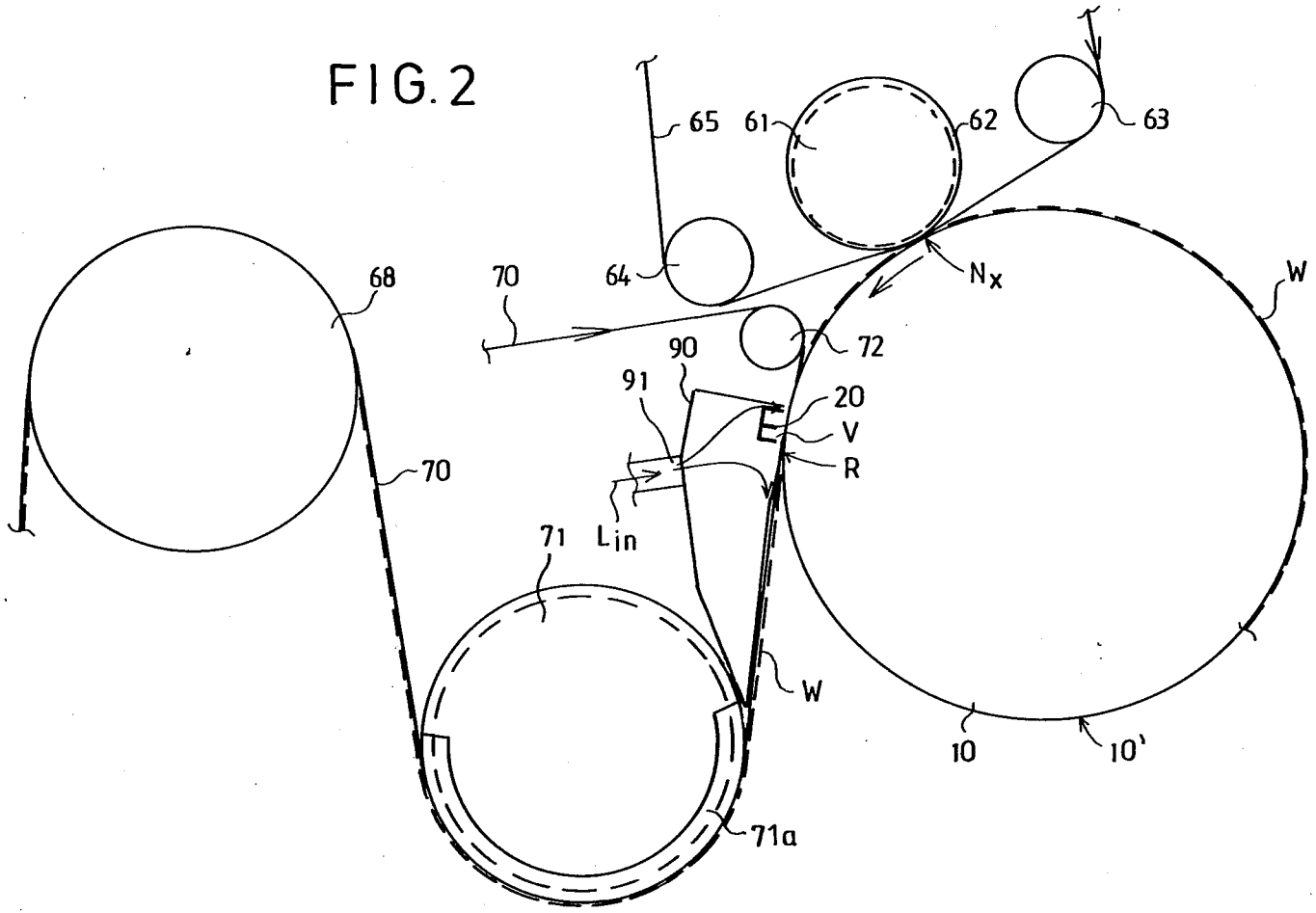
FIG. 2 illustrates a rear end of the press section in greater detail, in which the present invention is applied, and in which transfer of the web from the press section to a drying section is fully closed due to the present invention.

Accordingly to FIG. 2, a fully closed draw is used in the detaching of the web W from the face 10' of the central roll 10, so that the drying wire 70 is guided by a guide roll 72 of the drying section, and is passed onto the face 10' of the roll 10 before the detaching point R, in connection in which an induction heating device 20 in accordance with the present is placed. A blow box 90 is placed around the heating device 20, which is marketed by the assignee under the trademark "PRESS RUN". Air is passed into the blow box 90 through a pipe 91, in the direction of the arrow $L_{in}$.

The web W is detached from the roll face 10' by means of the vaporizing effect of the device 20, in accordance with the present invention, and made to adhere to the outer face of the drying wire 70 by means of the "PRESS RUN" box 90. The web W is passed under the suction effect of the box 90 onto a leading roll 71, with a suction 71a thereof maintaining the web W on the outer face of the drying wire 70, when the web is at a side of the outside curve. The web W then moves on the drying wire 70 onto a first drying cylinder 68, and from there, further as a closed draw onto the following drying cylinders which are arranged in a manner known in and of itself.

As in known in the prior art, a certain detaching tension had been necessary for the web W, this tension being produced by means of a difference in speed, i.e. so-called draw difference between the roll face 10' and the drying wire 70. Such difference extended the web W. Due to the vaporization detaching of the present invention, this detaching tension is not necessarily needed, so that it is possible to use a closed draw of the type illustrated in FIG. 2, or any other corresponding closed draw, for example one in which in the case illustrated in FIG. 1, the guide roll 66 has been displaced so as to reach contact with the roll face 10' and to form a slightly loaded transfer nip (not illustrated) with the roll face 10'.

In the present invention, the central roll 10 that is used is, as a rule, a roll with a metallic mantle, preferably a roll of ferromagnetic material, i.e. of roll material that is also preferred to rock material both constructionally and in view of the operation thereof.

Figure 3:
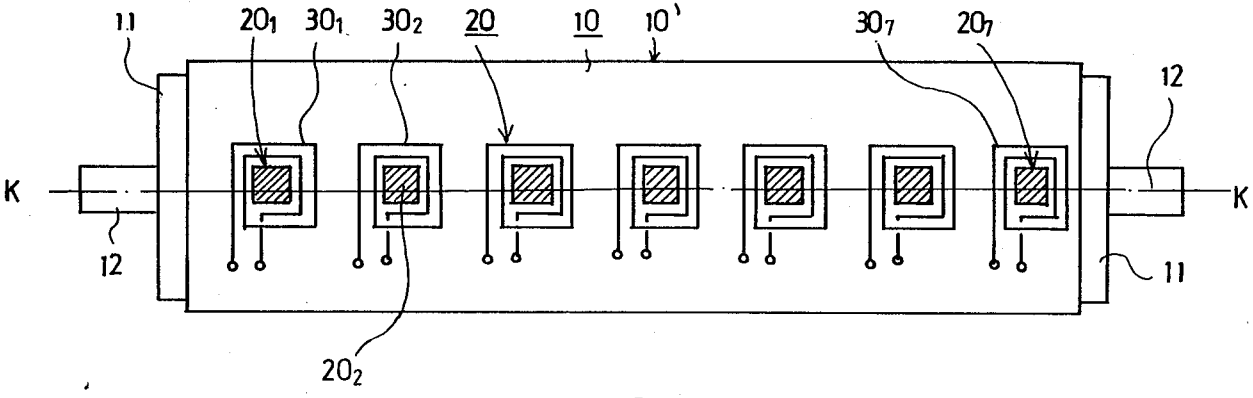
FIG. 3 is a schematic illustration in the machine direction of the principles of an induction heating device intended for application of the present herein.
Figure 4:
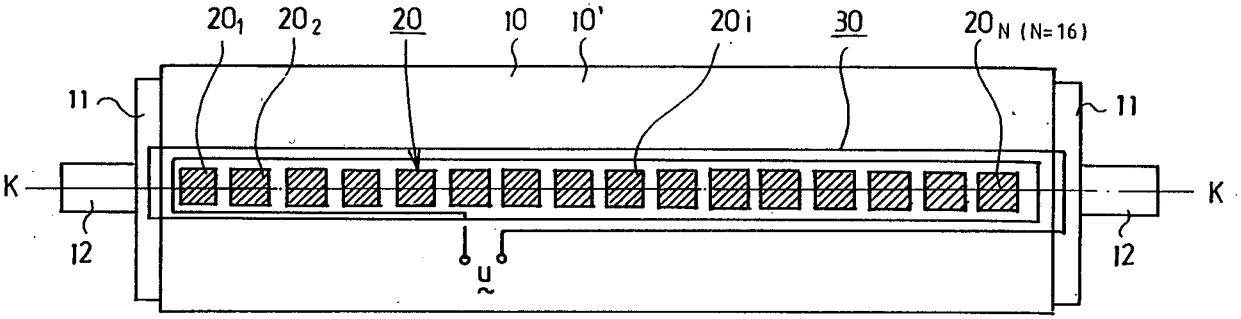
FIG. 4 illustrates a second embodiment of the principles of an induction heating device in a manner corresponding to the illustration of FIG. 3.

The press roll 10 illustrated in FIGS. 3 and 4 has a smooth and hard face 10' and a cylindrical mantle which is made of suitable ferromagnetic material which has been chosen in consideration of the strength properties of the roll and of the inductive and electromagnetic local heating in accordance with the present invention. The roll 10 is rotatably mounted around the central axis K—K thereof, through ends 11 and axle journals 12. Bearings on the axle journals 12 are fitted in bearing housings. The bearing housings are attached to a supporting frame of the roll, which is situated on a base.

It is possible to fit crown-variation or crown-adjustment devices, known in and of themselves, in the interior in the roll 10 in which there is plenty of room due to the present invention, because it is not necessary to use heating apparatus operating with a liquid medium or other, corresponding heating apparatus in the interior of the roll 10. However, these heating apparatus need not be completely excluded, and may be used in conjunction with the present invention.

In accordance with the present invention, the roll 10 is arranged to be inductively and electromagnetically heated by means of eddy currents, so that temperature of a very thin surface layer of the roll 10 is raised, due to this heating, to a considerably high level, generally to about 110° C.–130° C. Component cores $20_1$, $20_2$ . . . $20_N$ of an iron core are arranged in substantially the same horizontal line with one another over an axial direction of the roll, in the proximity of the roll 10, to accomplish this inductive local heating. These component cores $20_N$ form a magnetic-shoe apparatus 20 which further includes an excitation winding 30, or individual windings $30_1$ . . . $30_N$ for each component core (FIG. 3). The inductive heating is carried out free of contact, so that a small air gap V remains between the iron core 20 and the roll 10 face 10', the magnetic fluxes of the iron core being closed or concentrated through this air gap V onto the roll 10 mantle, thereby causing heating effect in the same.

An excitation winding $30_1$ . . . $30_7$ is shown about each component core $20_1$ . . . $20_7$ in FIG. 3. A second, alternative embodiment of the present invention is similar to that illustrated in FIG. 4, in which all the component cores $20_1$ . . . $20_N$ (N=16) have a common excitation winding 30 which has two turns, according to FIG. 4. According to FIG. 7, the excitation winding 30 of the iron core 20 has only one turn.

According to an alternative embodiment of the present invention, each component core is arranged to be separately displaceable in a radial plane of the roll 10, so as to adjust the magnitude of the active air gap V, and at the same time, the heating capacity. For this purpose, each component core is attached to the frame by means of an articulated joint. Displacing of the component cores can be arranged by means of various mechanisms. As a rule, the air gaps may vary, e.g., within the range of about 1 to 100 mm. With respect to the mechanical devices for the adjustment of the air gaps, the construction thereof not being described herein, reference is made to the assignee's Finnish patent application No. 83,3589, corresponding to U.S. Pat. No. 4,675,487.

With respect to the electrotechnical background of the present invention, the following has been ascertained. When a variable magnetic field has been provided in a material that conducts electricity, eddy current and hysteresis losses are produced in the material and the material is heated, as is well known. The power (P) of the eddy currents depends upon the intensity (B) of the magnetic field and on the frequency (f) of variation of the magnetic field as follows:

$$P = B^2 . f^2 \quad (1)$$

The variable magnetic field produced on the roll 30 is closed or concentrated between a front face of the iron core in the apparatus 20, and the air gaps V through the mantle of the roll 10. This magnetic field induces eddy currents in a surface layer of the roll mantle 10, the eddy currents generating heat due to the high resistance in the roll mantle 10. The distribution of the eddy currents induced in the mantle 10 in the direction x of the radius of the roll, follows the law $$I_x = I_o e - x/\delta \quad (2)$$

Where $I_x$ is current density at a depth X taken from the mantle face 10', $I_o$ is current density on the face 10' of the mantle 10, and δ is depth of penetration. The depth of penetration has been defined as the depth at which the current density has been lowered to 1/e of the current density $I_0$. For the depth of penetration, the following expression has been obtained:

$$\delta = \frac{1}{2\pi} \sqrt{\frac{10^7 \rho}{f\mu}} \quad (3)$$

wherein ρ is the specific resistance of the material, f is the frequency of the magnetizing current, and μ is the relative permeability of the material.

This expression show that with a higher frequency, the depth of penetration is reduced. When steel is heated, both the electrical conductivity and the permeability are reduced with a rising temperature.

In the present invention, heating capacities are used, as a rule, which are of the order of about 400 kW/m². As is well known, the smaller the air gap V, the larger the proportion of the electric power passed to the apparatus through the winding 30 which is transferred into the roll mantle 10 to be heated.

Figure 6:
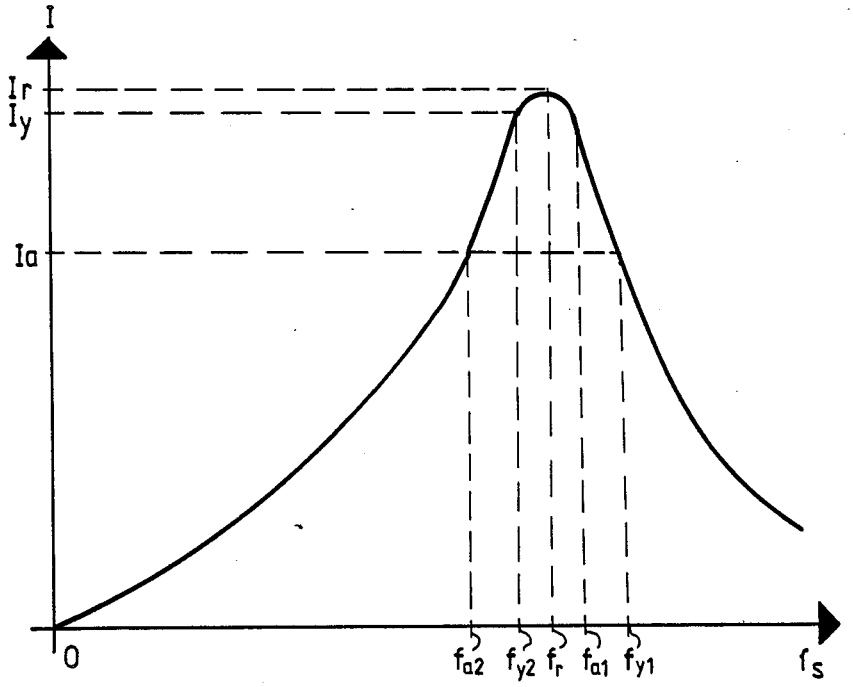
FIG. 6 is a graphical illustration of relationship of current of induction heating coil or coils in resonance, in a inductive heating device of the present invention, as a function of frequency thereof.
Figure 7:
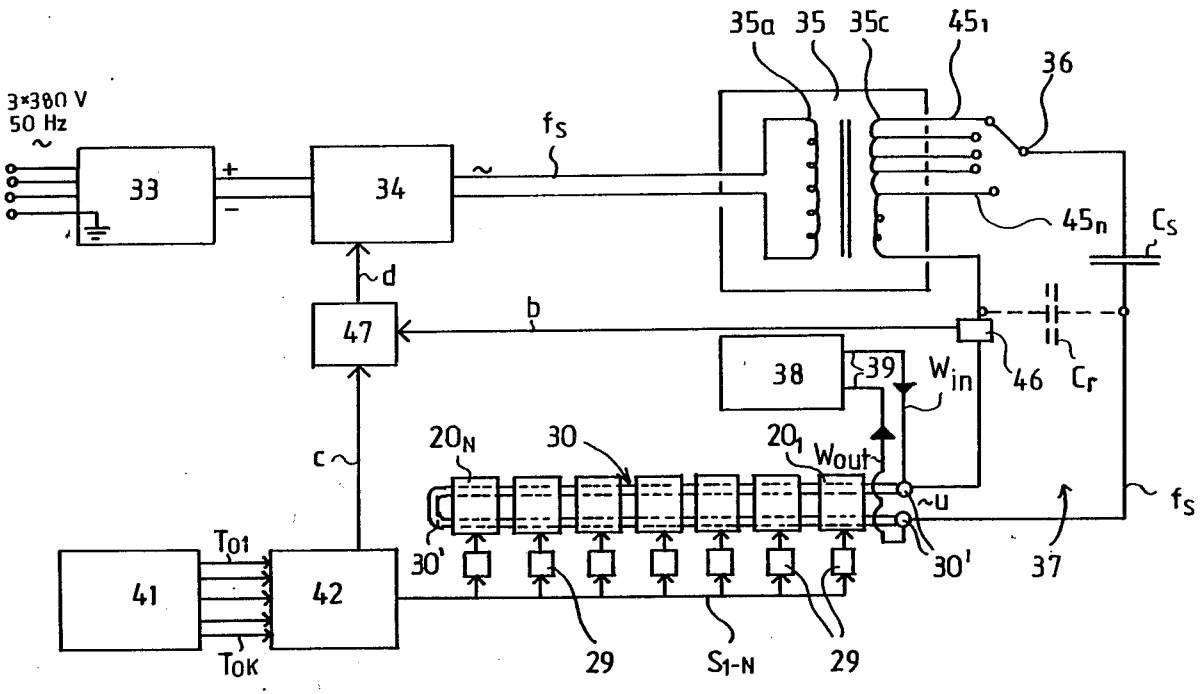
FIG. 7 is a block diagram illustrating a second exemplary embodiment of an induction heating device of the present invention, in a manner similar to the illustration in FIG. 5.

In accordance with FIG. 7, the electric power feeding the induction coil 30 is taken from a 50 Hz three-phase network (3×380 V). By means of a rectifier 33, the AC current is converted to DC current, which is, by means of an inverter based on power electronics and known in and of itself, converted to either constant-frequency or variable-frequency ($f_s$) AC current. Adjustment of the positions of the component cores $20_1$ . . . $20_N$ in the iron core 20, can be carried out, e.g., by means of the automatic closed regulating systems illustrated in FIGS. 5 and 6. The adjusting motors are stepping motors 29, which receive control signals $S_{l\text{-}N}$ from regulation system 42. This regulating system 42 is controlled by a detector device 41 which is, e.g. an apparatus for measurement of temperature, by means of which factual values of surface temperature $TO_{01}$ . . . $TO_{0K}$ of the roll 10 are measured within the detaching area R at several different points over the axial direction K-K of the roll 10. The regulating system 42 includes a set-value unit, by means of which it is possible to set the temperature profile so as to optimize the web W detaching processing.

In FIG. 7, reference No. 30' denotes terminals of coil 30 to which a voltage u is supplied. Reference numeral 38 denotes a unit, e.g. a pump, from which cooling fluid Win is conducted through tube 39 into coil 30, and to which cooling fluid returns through tube 39, as flow $W_{out}$. Coil 30 may then be made, e.g., of copper tubing, through which cooling fluid $W_{in}$-$W_{out}$ flows from pump 38 through tubes 39.

The output of the inverter 34 which changes direct-current power to alternating current power is fed through a matching transformer 35 into an LC resonance circuit 37 in accordance with the present invention, the effect and operation of which are illustrated in FIG. 6. In a manner known in and of itself, the transformer 35 has a primary circuit **35*a*, a core 35*b*, and a secondary circuit 35*c*. The secondary circuit has n pcs. of taps $45_1$ . . . $45_n$ which can be connected via a change-over switch 36 to the resonance circuit 37, and by means of which the power is fed into the induction coil 30**. As is well-known, the resonance frequency of an RLC circuit connected in series can be calculated from the formula:

$$f_r = \frac{1}{2\pi\sqrt{LC}} \quad (4)$$

where L is the inductance of the resonance circuit and C is the capacitance thereof.

Figure 5:
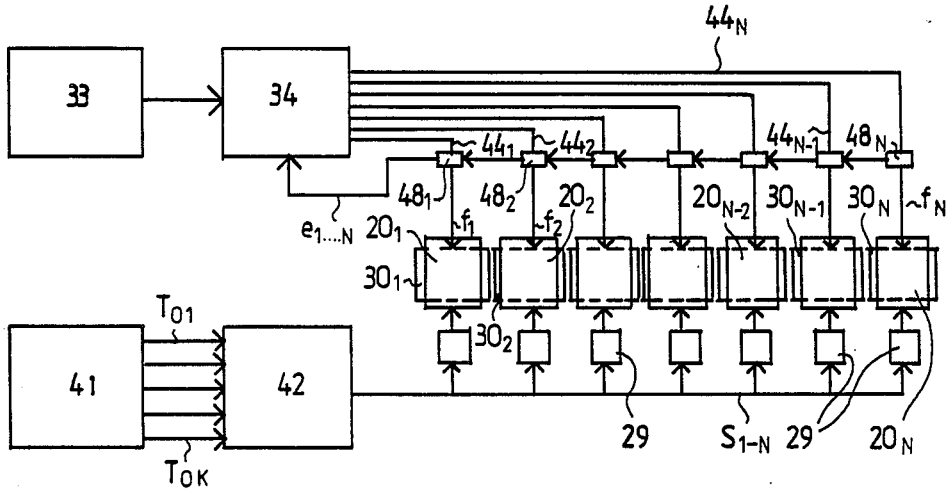
FIG. 5 is a block diagram illustrating a first exemplary embodiment of an induction heating device in accordance with the present invention.

FIG. 6 illustrates dependance of the current I in the circuit 37 on the frequency $f_s$. In resonance, the current $I_r = U/R$, wherein R is the resistance of the circuit 37 and U the terminal voltage thereof. In FIG. 5, it is assumed that the voltage U is non-varying.

The efficiency of the transfer of heating capacity is at the optimum when the operation takes place at the resonance frequency $f_r$. However, due to several reasons, it is not optimal to operate at the resonance frequency $f_r$ and/or simultaneously at both sides of the same. Rather, the frequency of operation is chosen within the area $f_{al}$ to $f_{yl}$ above the resonance frequency $f_r$ or correspondingly within area $f_{a2}$ to $f_{y2}$ below the resonance frequency $f_r$. Within the scope of the present invention, these frequency ranges are preferably chosen as follows:

$f_{al}$ to $f_{yl}$=about (1.01 . . . 1.15)×$f_r$ or $f_{a2}$ to $f_{y2}$=(about 0.85 . . . 0.99)×$f_r$.

According to FIG. 7, a series capacitor $C_s$ is used in the RLC circuit. The circuit 37 is tuned with basic tuning with the transmission ratio of the transformer 35 being chosen by means of the switch 36 so that resonance frequency $f_r$ calculated from formula (4) becomes correctly positioned in accordance with the principles given above.

FIG. 7 illustrates a parallel capacitor $C_r$, by means of broken lines. This parallel capacitor can be used instead of or along with the series capacitor $C_s$. As is well-known, the resonance frequency $f_r$ is a parallel resonance circuit whose induction coil (L) has a resistance R and capacitance C, and which is calculated as follows:

$$f_r = \frac{1}{2\pi\sqrt{LC}}\sqrt{1 - \frac{R^2C}{L}} \quad (5)$$

The above equation (5) includes a factor dependent on the resistance R.

However, a series resonance circuit is generally preferable, in view of the objects of the present invention, especially from the point of view of adjustment and control.

With the scope of the present invention, the resonance frequency is generally chosen within the range $f_r$=about 0.5 to 2 MHz, preferably about 0.8 to 1.5 MHz. The frequency range $f_r$=about 0.8 to 1.2 MHz, has been determined to be especially advantageous.

In accordance with the general principles of the present invention, in order to maintain the efficiency of the power high and to eliminate any phenomena of instability, i.e. "risk of runaway", the operating frequency $f_s$ is automatically arranged to be adjusted in accordance with impedance of the resonance circuit 37, so that the operating frequency $f_s$ remains near the resonance frequency $f_r$, but yet at a safe distance away therefrom in view of the risk of runaway, i.e., within the areas $f_{yl} - f_{al}$ or $f_{y2} - f_{a2}$ as illustrated in FIG. 6.

Measurement of impedance of the resonant circuit 37 may be based, e.g., on measurement of the current I passing in the circuit. This mode of measurement is illustrated in FIG. 7 by block 46 from which the control signal d is controlled from the regulating unit 47 which alters the frequency $f_s$ of the frequency convertor 34 on the basis of the control signal b (the invertor 34 may also comprise a function that converts the output current variable frequency ($f_s$) to AC current). A further mode of measurement of the impedance which may be an alternative mode which may be used in addition to the current measurement, is passing a control signal c from block 42 from which information can be obtained on position of the component cores $20_N$, i.e., on the various air gaps v, which substantially determine the impediance by acting upon the inductance L. An alternative mode of adjustment is passing feedback signals from the stepping motors 29 into the block 47, and further to act upon the output frequency $f_s$ of the frequency converter 34.

FIG. 5 illustrates an alternative embodiment of the invention in which each component core $20_N$ is provided with an induction coil of its own, in accordance with FIG. 3. A separately adjustable frequency $f_1$–$f_N$ is passed from the frequency converter 34 by means of the feed cable $44_1$–$44_N$. When the air gap V of each component core 20 is adjusted by means of the stepping motors 29, the resonance frequency $f_r$ of each individual resonance circuit is changed. Measurement of the impedance of each individual resonance circuit is carried out by means of separate current meters $48_1$–$48_N$ with the frequency converter unit 34 or group being controlled by means of the signal series $e_1$–$e_N$ received from the current meters $48_1$–$48_N$. This signal series $e_1$–$e_N$ contains information, e.g., on the air gaps V of the different component cores. Each frequency $f1_1 - f_N$ can then be made optimal in view of the efficiency of the power supply and of the stability of the adjustment in each component core. In view of achieving a sufficiently low depth of penetration, the frequencies $f_1 - f_N$ are within the range of about 0.5 MHz to 2 MHz.

By means of a circuit similar to that illustrated in FIG. 5 within the scope of the present invention, it is also possible to accomplish a different type of adjustment in the heating capacity, so that either the component cores $20_1 - 20_N$ may be made static or stationary, or adjustment of the air gaps V thereof may just be carried out according to a basic-setting adjustment and not as an operating adjustment proper. In this case, it is possible by varying each frequency $f_1 - f_N$ individually, on the basis of FIG. 6, to act upon the curent I fed into the circuit and thereby on the heating capacities of the individual component cores $20_N$ and ultimately upon the temperature profile on the roll 10. If this operation takes place within the areas noted above below or above the resonance frequency $f_r$ by varying the feed frequencies $f_1 - f_N$, it is possible to effect or influence the current I within the area $I_y - I_a$. The intensity B of the magnetic field (formula 1) is substantially proportionally dependent upon the magnetization current. The mode of adjustment based on variation of frequency may be used either alone for controlling the temperature profile of the roll 10, or may be used in addition to the air-gap adjustment.

The temperature of the roll face from which the web W is intended to be detached in the present invention is maintained generally within the range of about 60° C. to 90° C., preferably at about 70° C. In accordance with the present invention, temperature of the roll face is raised by the momentary and local induction heating from a basic level given above, by about 30° C. to 70° C., preferably by about 50° C., to a temperature about 110° C. to 130° C., preferably to about 120° C., whereby a vaporization phenomena takes places momentarily and locally within the detaching area R, and a vapor film is formed between the web W on the roll face 10' and thereby detaches the web W efficiently. In special cases, relief may already be obtained for the difficulties concerned, even with roll face temperatures of the order of about 95° C.

The detaching powers required in the invention (i.e. heating capacity per meter of length of the roll 10), e.g., at a web speed of about 20 m/s, are of the order of about 30 to 50 kW/m, more appropriately of an order of about 40 kW/m, which causes a momentary rise in the temperature of the roll face by about 50° C. in the case of steel.

The preceding description of the present invention is merely exemplary, and is not intended to limit the scope thereof. Various details of the present invention may vary within the scope of the inventive concepts set forth above, which have been presented for exemplary purposes only.

I claim:

1. Method for detaching a moist paper web from a surface of a roll, comprising the steps of:

detaching the web from said roll surface, directing a heating effect at the web from outside the roll and within a vicinity of a point of detachment of the web off the roll, said vicinity being at said detachment point or immediately upstream thereof in a direction of web travel, and thereby heating water which is present between the web and the roll surface within the vicinity of the detaching point, so as to detach the web from the roll surface, wherein the directing of heating is locally applied to the web for just a short period of time in the vicinity of the detaching point as the web passes thereby, so that the water is locally heated within said vicinity, and providing a mantle on said roll or an outer coating on a mantle of said roll, said mantle or coating being a material which is at least partially magnetically conductive, wherein said directing step comprises applying an inductive heating effect to said roll mantle without contact and with a sufficiently high frequency so that depth of penetration of the heating effect into the roll mantle remains low so as to locally raise the surface temperature of the roll at the detaching point.

2. The method of claim 1, comprising the additional step of vaporizing at least part of the water by said heating.

3. The method of claim 1, wherein the roll is a smooth-surfaced press roll defining at least one press nip.

4. The method of claim 3, wherein the inductive heating is applied with a frequency within the range of about 0.5 to 2 MHz.

5. The method of claim 4, wherein the frequency range is about 0.5 to 1.5 MHz.

6. The method of claim 3, comprising the additional step of maintaining temperature of the roll surface within the range of about 60° C.–90° C.

7. The method of claim 6, wherein the temperature is maintained about 70° C.

8. The method of claim 3, comprising the additional step of raising temperature of the roll surface by about 40° C.–60° C. within the vicinity of the detaching point.

9. The method of claim 8, wherein the temperature is raised by about 50° C.

10. The method of claim 8, wherein the heating is applied with a capacity per meter of length of the roll of about 30 to 50 kW/m.

11. The method of claim 10, wherein the heating capacity is about 40 kW/m.

12. The method of claim 3, comprising the additional step of adjusting the heating effect applied over an axial direction of the roll.

13. The method of claim 12, wherein the heating effect is axially adjusted by carrying out at least one of the following steps:

adjusting magnitude of an air gap between the roll surface and a device providing said heating frequency, adjusting the frequency applied from a device, and adjusting at least one of voltage and current applied to a device applying said frequency.

14. The method of claim 3, wherein said roll is a central roll in the press section of a paper machine about which a plurality of press nips are formed, and comprising the additional step of:

transferring the web in a closed draw from the point of detachment off the roll.

15. The method of claim 14, comprising the additional steps of passing a transfer fabric past the detaching point, and forcing the web to adhere to the transfer fabric after being detached off the roll.

16. The method of claim 15, wherein the transfer fabric is a drying wire, the web is forced to adhere to the drying wire by applying suction, and comprising the additional step of passing the thus-adhering web onto a drying or lead-in cylinder.

17. The method of claim 16, comprising the additional step of passing the thus-adhering web over a suction sector of a suction roll, before passing the same over the drying or lead-in cylinder.

18. The method of claim 15, comprising the additional step of forming a transfer nip between said central roll and a guide roll for the transfer fabric.

19. The method of claim 3, comprising the additional step of raising the temperature of the roll surface by about 30° to 70° C. within the vicinity of the detaching point.

20. The method of claim 6, wherein the temperature of the roll surface is raised to about 110° C. to 130° C. within the vicinity of the detaching point.

21. The method of claim 3, comprising the additional step of transferring the web to a drying section after the same is detached off the roll.

22. The method of claim 21, wherein the web is detached off the roll and transferred as an open draw to a drying fabric of the drying section.

23. The method of claim 3, wherein said vicinity is located on said roll after a final nip formed with said roll in a direction of web travel.

24. The method of claim 15, wherein said vicinity is situated at a location where said transfer fabric has already lapped the web on said roll surface.

25. The method of claim 1, comprising the additional step of:

transferring the web in a closed draw from the point of detachment off the roll.

26. The method of claim 25, comprising the additional step of blowing air in a direction of web travel in the vicinity of the detaching point of the web off the roll, whereby the web is caused to adhere to a fabric forming said closed draw, by effect of suction generated by said blowing air.

* * * * *